US008894162B2

(12) United States Patent
Kashiwaguma

(10) Patent No.: US 8,894,162 B2
(45) Date of Patent: Nov. 25, 2014

(54) STAY FOR OPENING AND CLOSING OF DOOR

(75) Inventor: Kazuaki Kashiwaguma, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 109 days.

(21) Appl. No.: 13/203,134

(22) PCT Filed: Nov. 25, 2009

(86) PCT No.: PCT/JP2009/069822
§ 371 (c)(1),
(2), (4) Date: Aug. 24, 2011

(87) PCT Pub. No.: WO2010/097996
PCT Pub. Date: Sep. 2, 2010

(65) Prior Publication Data

US 2012/0000130 A1 Jan. 5, 2012

(30) Foreign Application Priority Data

Feb. 27, 2009 (JP) ..... 2009-045498

(51) Int. Cl.

| | |
|---|---|
| ***A47B 95/02*** | (2006.01) |
| ***A47B 88/00*** | (2006.01) |
| ***E05F 1/10*** | (2006.01) |
| *E05C 17/20* | (2006.01) |

(52) U.S. Cl.
CPC ..... *E05F 1/1058* (2013.01); *E05C 17/20* (2013.01); *E05Y 2201/416* (2013.01); *E05Y 2900/20* (2013.01)
USPC ..... 312/319.2; 312/327

(58) Field of Classification Search
USPC ..... 312/327, 328, 319.2, 325, 109; 16/334, 16/366, 371, 370, 357, 358, 360, 49, 63, 16/65, 50; 49/346
See application file for complete search history.

(56) References Cited

U.S. PATENT DOCUMENTS 1,335,429 A * 3/1920 Danielson ..... 49/346
1,794,477 A * 3/1931 Sodergren ..... 292/275

(Continued)

FOREIGN PATENT DOCUMENTS

EP 1050230 11/2000
GB 1175773 12/1969

(Continued)

OTHER PUBLICATIONS

Machine translation of Jp H0640255.*

(Continued)

*Primary Examiner* — Darnell Jayne
*Assistant Examiner* — Timothy M Ayres
(74) *Attorney, Agent, or Firm* — Young & Thompson

(57) ABSTRACT

A stay for opening and closing of a door does not become a hindrance when the door is open and is visually uncluttered. The stay has: a main body mounted to a housing; an arm having one end rotatably connected to the main body; a biasing element on the main body and biasing the arm so the arm rotates in at least one direction; an arm slider mounted to the arm and slidable in the longitudinal direction of the arm; and a mounting seat installed on the door and rotatably connected to the slider. As the slider is slidable relative to the arm and rotatable relative to the mounting seat installed on the door, an opening and closing force can be transmitted to the door from the one arm without requiring two links. Thus, the stay does not become a hindrance to a user and is visually uncluttered.

11 Claims, 12 Drawing Sheets

(56) References Cited

U.S. PATENT DOCUMENTS

| | | | | |
|---|---|---|---|---|
| 2,727,776 | A * | 12/1955 | Brownlee et al. | 292/276 |
| 3,575,483 | A * | 4/1971 | Church et al. | 312/328 |
| 3,765,053 | A * | 10/1973 | Anweiler | 16/49 |
| 3,906,587 | A * | 9/1975 | Little | 16/289 |
| 5,401,096 | A * | 3/1995 | Stang | 312/319.2 |
| 5,882,099 | A * | 3/1999 | Salice | 312/328 |
| 5,904,411 | A | 5/1999 | Hayakawa | |
| 5,931,554 | A * | 8/1999 | Koopman | 312/405 |
| 5,971,514 | A | 10/1999 | Hayakawa | |
| 6,361,132 | B2 * | 3/2002 | Kawanabe | 312/319.2 |
| 6,557,300 | B1 | 5/2003 | Bantle | |
| 7,012,675 | B1 * | 3/2006 | Zhang et al. | 355/75 |
| 7,168,477 | B2 * | 1/2007 | Salice | 160/213 |
| 7,448,703 | B2 * | 11/2008 | Kung | 312/327 |
| 2007/0124893 | A1 * | 6/2007 | Brustle | 16/296 |
| 2007/0257538 | A1 * | 11/2007 | Brunnmayr | 297/423.12 |

FOREIGN PATENT DOCUMENTS

| | | |
|---|---|---|
| JP | 6-40255 | 5/1994 |
| JP | 8-177291 | 7/1996 |
| JP | 3120212 | 12/2000 |

OTHER PUBLICATIONS

International Search Report, PCT/JP2009/069822, Dec. 22, 2009.
Extended European Search Report dated Feb. 7, 2014; Application No. 09840843.8.

* cited by examiner (a)

Prior Art (b)

Prior Art

STAY FOR OPENING AND CLOSING OF DOOR

TECHNICAL FIELD

The present invention relates to a stay for opening and closing of a door, which is capable of facilitating an opening and closing operation of the door or a cover installed on a housing via a hinge in an openable and closable manner.

BACKGROUND ART

As a conventional stay for opening and closing of a door which facilitates an opening and closing operation of the door or a cover, there is known a stay having a slider crank mechanism 5 inside as illustrated in FIGS. 12(*a*) and 12(*b*) (see PL 1). A main body 1 of the stay is rotatably connected to an end 2*a* of an arm 2. The main body 1 is mounted on a housing 6 and the arm 2 is connected to the door 7. A force for assisting the opening and closing operation is transmitted to the door 7 from the arm 2.

The main body 1 is provided with a coil spring 8. An end of a link 3 is rotatably connected to a main-body slider 4 biased downward by the coil spring 8. The other end of the link 3 is connected to a pivot base part of the arm 2. These main-body slider 4, link and arm 2 form the slider crank mechanism 5. When the main-body slider 4 moves back and forth, the arm 2 equivalent to a crank rotates via the link 3. Amounting seat 10 is rotatably mounted to the other end 2*b* of the arm 2 via another link 9. The door 7 is attached to this mounting seat 10.

As illustrated in FIG. 12(*a*), when the door 7 is closed, a torque T1 acts on the arm. 2 in a clockwise direction by a biasing force of the coil spring 8. Thus, as the torque in the closing direction still acts on the closed door 7, the closed state of the door can be kept stable. Meanwhile, as illustrated in FIG. 12(*b*), when opening the closed door 7, the arm 2 rotates and the slider crank mechanism 5 goes beyond a change point. Then, a torque T2 acts on the arm 2 in a counterclockwise direction by the biasing force of the coil spring 8. As the door 7 is further acted upon by the torque in the opening direction, the opening operation of the door 7 can be facilitated and the open angle of the door can be kept constant.

CITATION LIST

Patent Literature

PL 1: Japanese Patent No. 3120212

SUMMARY OF INVENTION

Technical Problem

However, in the conventional stay, two links (arm 2 and link 9) are required between the housing 6 and the door 7 in order to open and close the door smoothly. Then, as illustrated in FIG. 12(*b*), when the door 7 is open, the two links are arranged in a line and juts out like a diagonal bracing between the housing 6 and the door 7. Therefore, there arises a problem that when the door 7 gets open, the two links become hindrance to storage and are visually unpleasant.

The present invention solves such a problem of the conventional stay for opening and closing of a door and has an object to provide a stay for opening and closing of a door, which does not become a hindrance to a user when the door is open and is visually uncluttered.

Here, for example, the above-described stay for opening and closing of a door gives an additional force in the closing direction to a closed door and gives an additional force in the opening direction to the open door. When the door is heavy, it is necessary to give a great torque in the opening direction to the door in order to keep the attitude of the open door fixed. On the other hand, in order to reduce the operational feed when opening the closed door, it is necessary to reduce the torque in the closing direction given to the closed door.

However, the conventional stay has the following problem. If the spring force of the coil spring 8 is strengthened in order to keep the attitude of the open door fixed, it becomes difficult to give the closed door a small torque in the closing direction. On the other hand, if the spring force of the coil spring 8 is reduced in order to reduce the operational feel in opening the closed door, it becomes difficult to give a large torque in the opening direction to the open door.

Then, another object of the stay for opening and closing of a door of the present invention is to provide a stay for opening and closing of a door that is capable of freely controlling an opening and closing force transmitted to the door when opening and closing the door.

Solution to Problem

In order to solve the above-mentioned problems, one aspect of the present invention is a stay for opening and closing of a door, comprising: a main body mounted to a housing; an arm having one end rotatably connected to the main body; biasing means provided to the main body for biasing the arm so that the arm can rotate in at least one direction; an arm slider mounted to the arm so as to be slidable in a longitudinal direction of the arm; and a mounting seat installed on the door or cover and rotatably connected to the arm slider.

Another aspect of the present invention is a stay for opening and closing of a door, comprising: a main body mounted to a housing; an arm having one end rotatably connected to the main body; a main-body slider slidably provided on the main body and being biased in one direction by an elastic body; and a link rotatably connected to the main-body slider and the arm, wherein there are at least two pivots of the link relative to the arm or the main-body slider and when the link rotates, the pivots of the link relative to the arm or the main-body slider are changed from one pin to an opposite pin.

Advantageous Effects of Invention

According to the one aspect of the present invention, as the arm slider is provided slidable on the arm and the slide member can rotate relative to the mounting seat attached to the door, it is possible to transmit an opening and closing force to the door from one arm without requiring two links (arm and connecting link). Therefore, the obtained stay for opening and closing of a door does not become a hindrance to a user and is visually uncluttered.

According to the other aspect of the present invention, as the pins as pivot of the link are changed by rotating the link relative to the main-body slider or arm, it is possible to change at one stroke the biasing force of the elastic body transmitted from the main-body slider to the arm via the link. Therefore, it is possible to freely control the opening and closing force transmitted to the door when opening and closing the door.

DESCRIPTION OF EMBODIMENTS

Figure 1:
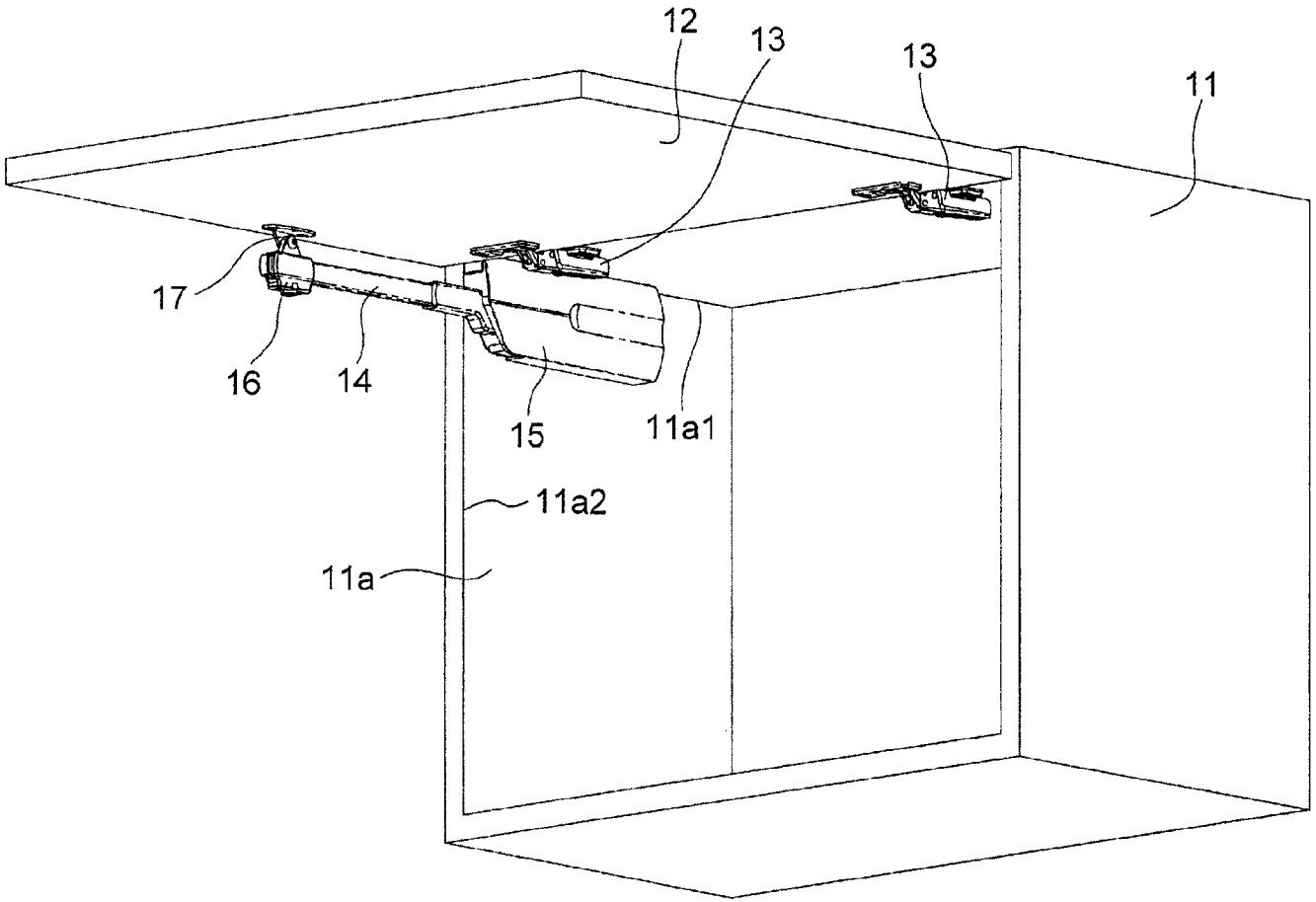
FIG. 1 is perspective view of a door and a housing on which is mounted a stay for opening and closing of a door according to a first embodiment of the present invention.

With reference to the attached drawings, a stay for opening and closing of a door (hereinafter referred to as "stay") according to the first embodiment of the present invention will be described in detail below. FIG. 1 is a perspective view of a housing 11 and a door 12 on which the stay for opening and closing of a door is mounted. The stay has a main body 15 fixed to the housing 11 and an arm 14 connected to the door 12 side. The arm 14 is mounted to the main body 15 rotatable in the vertical plane. When opening and closing the door 12, the arm 14 gives the door 12 a biasing force for assisting opening and closing of the door 12. Between the housing 11 and the door 12, a slid hinge 13 is mounted in addition to the stay. The rotation orbit of the door 12 is determined by the slide hinge 13. Here, the slide hinge 13 is a well-known hinge which rotation axis moves when the door 12 gets open. As the rotation axis of the slide hinge 13 moves, when the door 12 gets open, the clearance between the frame of the housing 11 and the door 12 can be made smaller.

As illustrated in FIG. 1, a main body 15 of the stay is mounted on an upper part of a side plate 11*a* of the housing 11. A side 11*a*1 at the ceiling side of the side plate 11*a* is orthogonal to a side 11*a*2 at the frame side and the main body 15 is mounted to be positioned at the corner of these sides. In the arm 14, an arm slider 16 is mounted slidable in the longitudinal direction of the arm 14. A mounting seat 17 is rotatably connected to the arm slider 16. The door 12 is attached to this mounting seat 17.

Figure 2:
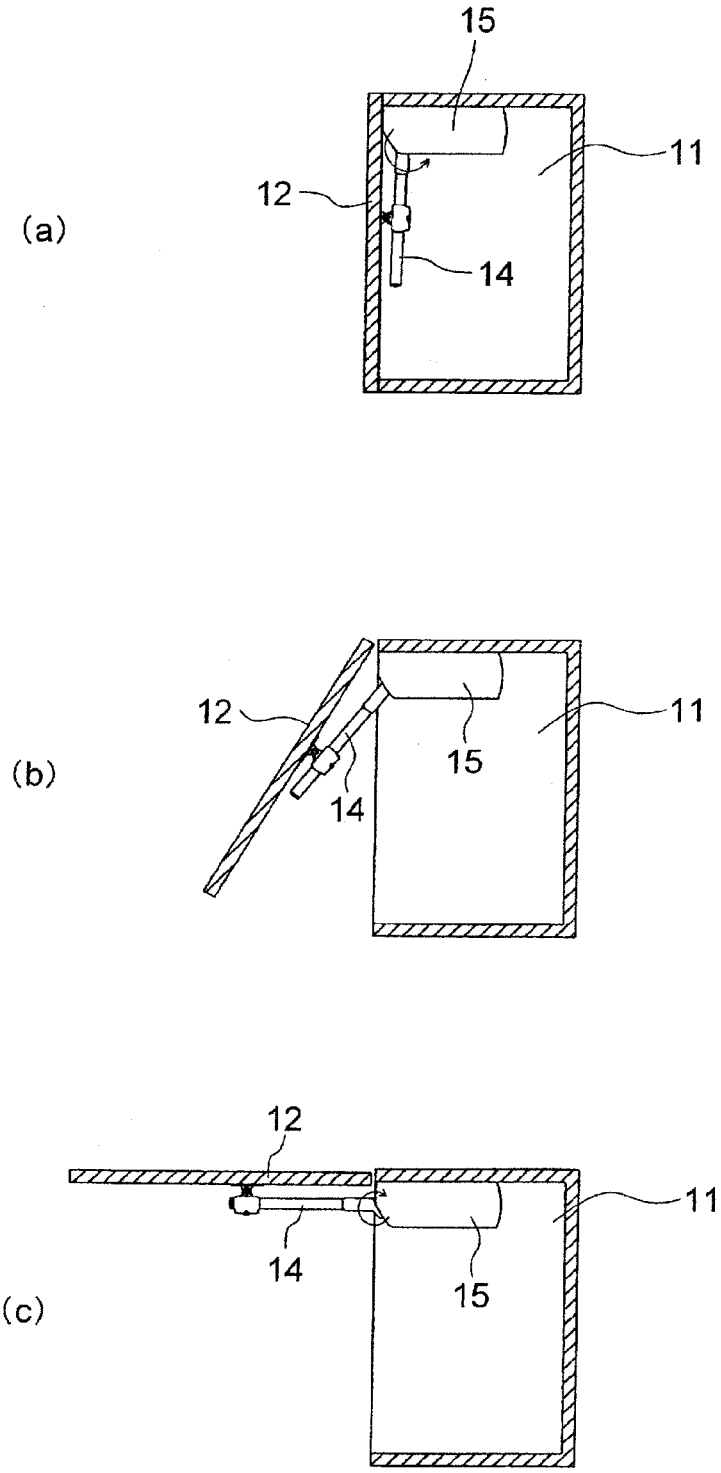
FIGS. 2(*a*) to 2(*c*) are cross sectional views each illustrating relation between the open and closed state of the door and the operation of the stay.
Figure 12:
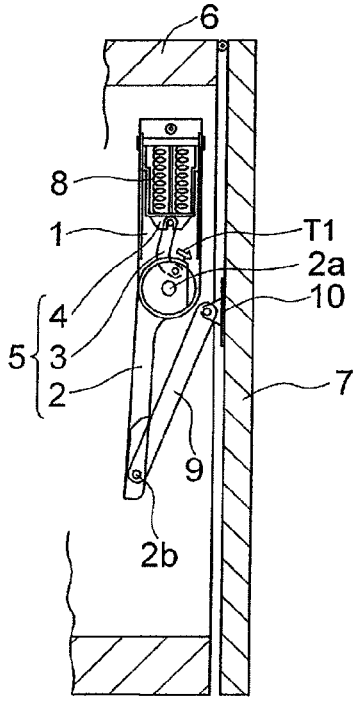
FIGS. 12(*a*) 12(*b*) are cross sectional views of a conventional stay for opening and closing of a door (FIG. 12(*a*) illustrates the door in the closed state and FIG. 12(*b*) illustrates the door in the open state).
Figure 12:
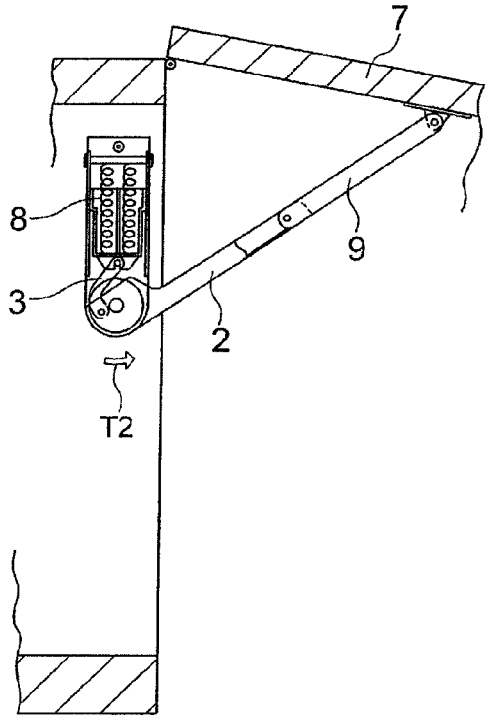

As illustrated in FIGS. 2(*a*) to 2(*c*), the arm 14 of the stay extends in approximately parallel to the door 12. When opening and closing the door 12, the arm 14 rotates relative to the main body 15 while it is kept in approximately parallel to the door 12. As illustrated in FIG. 12(*a*), when the door 12 is in the closed state, the arm 14 gives the door 12 an additional force in the closing direction. Therefore, the door 12 is kept stable in the closed state. As illustrated in FIG. 2(*b*), when the closed door 12 gets open, for example, 20 degrees or more, then, the arm 14 gives the door 12 a force in the opening direction. This force of the arm 14 in the opening direction facilitates the opening operation of the door 12 and makes it possible to keep any open angle of the door fixed. As illustrated in FIG. 2(*c*), the door 12 can open 90 degrees at the maximum. When closing the open door 12, if the door 12 gets closed up to 20 degrees, for example, (FIG. 2(*c*) to FIG. 2(*b*)), the door 12 closes automatically (FIG. 2(*a*)). In this embodiment, the door 12 is set out of the frame of the housing 11, or it is provided to cover the frame of the housing 11.

Figure 3:
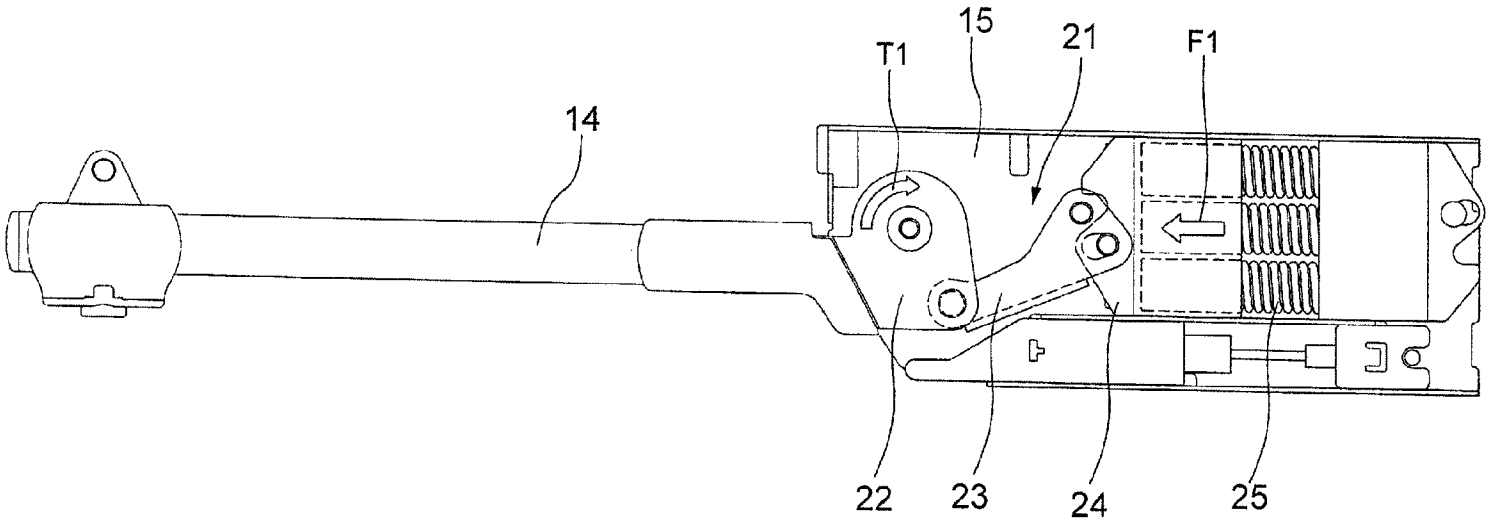
FIG. 3 is a substantial part cross sectional view of the stay for opening and closing of the door.
Figure 4:
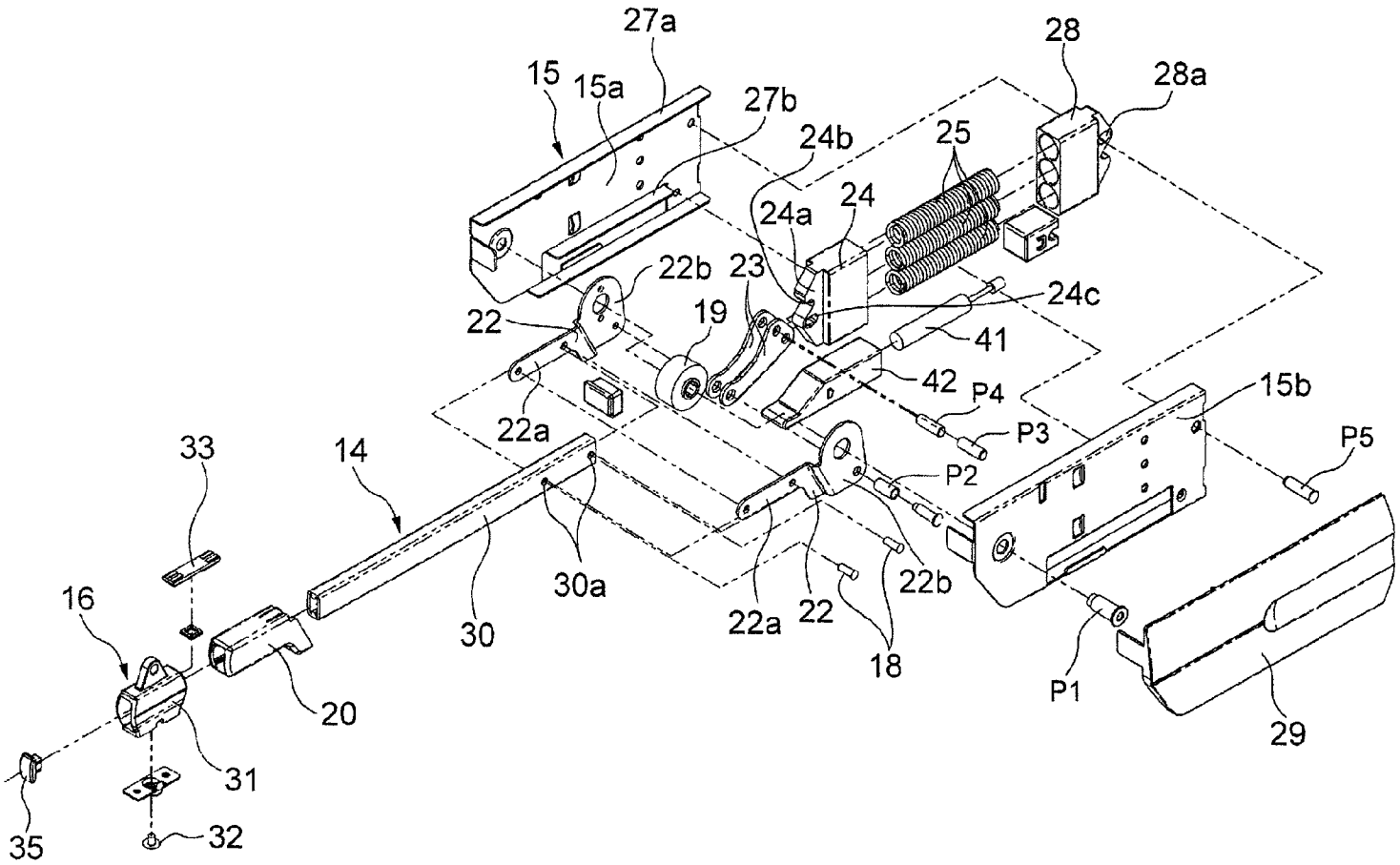
FIG. 4 is an exploded perspective view of the stay for opening and closing of the door.

FIG. 3 is a substantial part cross sectional view of the stay and FIG. 4 is an exploded perspective view of the stay. As illustrated in FIG. 3, the slider crank mechanism 21 is built in the main body 15. The slider crank mechanism 21 has the arm 14, a link 23 connected to an arm holding plate 22 of the arm 14, and a main-body slider 24 provided at the main body 15 to be slidable in one direction. The weight of the door 12 is supported by the biasing force of a coil spring 25 as an elastic body contained in the main body 15. In other words, the biasing force F1 of the coil spring 25 is converted to a torque T1 of the arm 14 by the main-body slider 24 and the link 23. The weight of the door can be supported by the torque T1 of the arm 14.

As illustrated in FIG. 2(*c*), when the door 12 is in the open state, the arm 14 is given a torque in the clockwise direction (in the opening direction of the door 12) by the biasing force of the coil spring 24. When the door 12 gets closed, for example, 20 degrees or less, the slider crank mechanism reaches the change point. As illustrated in FIG. 2(*a*), when the door 12 gets further closed, the arm 14 is given a torque in the counterclockwise direction (in the closing direction of the door 12) by the biasing force of the coil spring 25. This torque can be used by a catch force of the closed door 12.

As illustrated in FIG. 4, the main body 15 is combination of two-divided case half bodies 15*a* and 15*b*. Each of the case half bodies 15*a* and 15*b* is formed by bending a thin plate. The case half bodies 15*a*, 15*b* have guide walls 27*a* and 27*b* jutting to the inside. In the guide walls 27*a* and 27*b*, approximately box-shaped main-body slider 24 and spring receiver 28 are accommodated to be slidable in one direction along the guide walls 27*a* and 27*b*. A pin P1 as a pivot of the arm 14 is provided to run between the paired case half bodies 15*a* and 15*b*. For improve the appearance, the main body 15 is covered with a decorated cover 29.

An end of the arm 14 is rotatably connected to the main body 15 via the pin P1. The pin P1 is a pivot of the arm relative to the main body 15. The arm 14 has an elongating and hollow arm main body 30, a pair of arm holding plates 22 mounted to an end of the arm main body 30 and a cylindrical bearing 19 provided between the paired arm holding plates 22.

A cross section of the arm main body 30 is a flat box. At an end of the arm main body 30, a mounting hole 30*a* is formed for mounting the paired arm holding plates 22. Each of the paired arm holding plates 22 has a connecting part 22*a* elongating in accordance with the arm main body 30 and an enlarged part 22*b* which is enlarged relative to the connecting part 22*a*. The connecting part 22*a* of each arm holding plate 22 is inserted to an end of the arm main body 30. After the paired arm holding plates 22 and the arm main body 30 are connected to each other with the pin 18, an end of the arm main body 30 is covered with a frame-shaped fixation piece. An end in the opposite direction of the arm main body 30 is covered with a plug 35.

On the inner circumference of the bearing 19, the pin P1 is fit therein. Rotation of the arm 14 relative to the pin P1 is guided by this bearing 19. A link 23 is rotatably connected to the arm holding plates 22 via a pin P2. The pin P2, which is a pivot of the link 23 relative to the arm 14, is positioned in the arm holding plates 22 to be shifted in a plane from the pin P1 which is the pivot of the arm 14 relative to the main body 15.

Between the main-body slider 24 and the spring receiver 28, a plurality of coil springs 25 is accommodated. The plural coil springs 25 have one longitudinal ends inserted into plural cylindrical recesses of the main-body slider 24. The other ends are into plural cylindrical recesses of the spring receiver 28. The coil springs 25 are sandwiched between the main-body slider 24 and the spring receiver 28. The main-body slider 24 and the spring receiver 28 are slidable in one direction by the guide walls 27*a* and 27*b* of the case half bodies 15*a* and 15*b*. A pin P5 for restricting sliding of the spring receiver 28 is provided to run between the paired case half bodies 15*a* and 15*b*. In the spring receiver 28, a long hole 28*a* is formed for insertion of the pin P5. By the coil spring 25, the spring receiver 28 is acted upon by a biasing force in the right and back direction in the figure. Sliding in the right and back direction of the spring receiver 28 is restricted by the pin P5. Here, the main-body slider 24 and the spring receiver 28 take identical shapes. This is because a single die is used in injection molding of both of the main-body slider 24 and the spring receiver 28.

At an end of the main-body slider 24, a mountain-shaped projection 24*a* is formed. In this projection 24*a*, a recess 24*b* and a long hole 24*c* are formed as two pin receivers corresponding to the two pins P3 and P4 of the link 23. Out of the two pins, the pin P4 is inserted into the long hole 24*c* and the other pin P3 is fit in the recess 24*b*.

The link 23 is combination of two parallel link plates connected by a bottom plate and has a U-shaped cross section. An end of the link 23 is rotatably connected to the arm holding plates 22 via the pin P2. At the other end of the link 23, the above-mentioned two pins P3 and P4 are provided.

Figure 5:
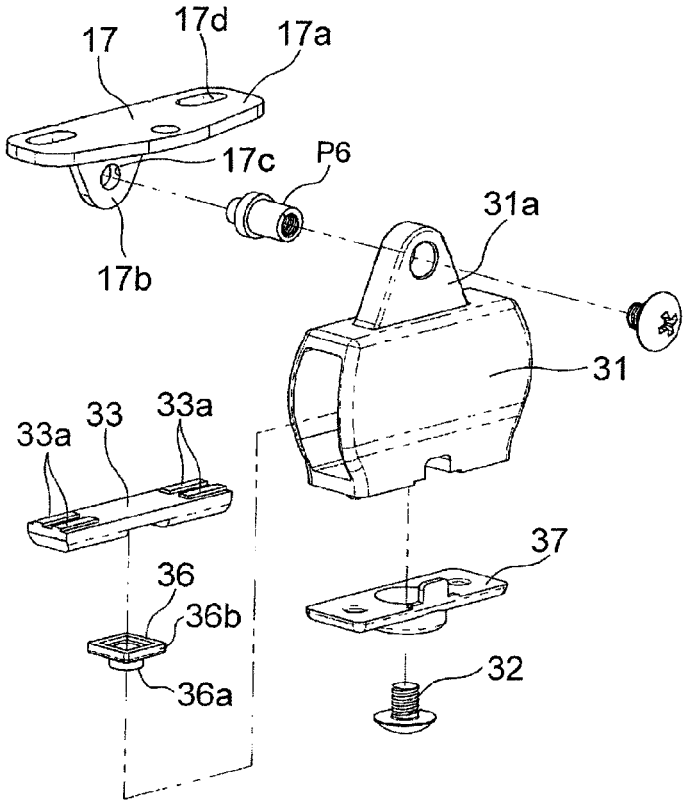
FIG. 5 is an exploded perspective view of an arm slider.

To the arm main body 30, the arm slider 16 is mounted slidable in the longitudinal direction of the arm main body 30. As illustrated in FIG. 5, the arm slider 16 has a frame-shaped slider main body 31 surrounding the arm main body 30, a position adjusting screw 32 fit in the slider main body 31 and a friction plate 33 provided between the arm main body 30 and slider main body 31.

In the slider main body 31, a mountain-shaped projection 31*a* is formed. The mounting seat 17 is rotatably mounted to this projection 31*a* via a pin P6. The mounting seat 17 has a plate-shaped plate main body 17*a* and an approximately triangular projection plate 17*b* projecting downward from the plate main body 17*a*. In the plate main body 17*a*, a through hole 17*d* is formed for installing on the door 12. In the projection plate 17*b*, a hole 17*c* is formed for insertion of the pin P6. The mounting seat 17 rotates around the pin P6.

Figure 6:
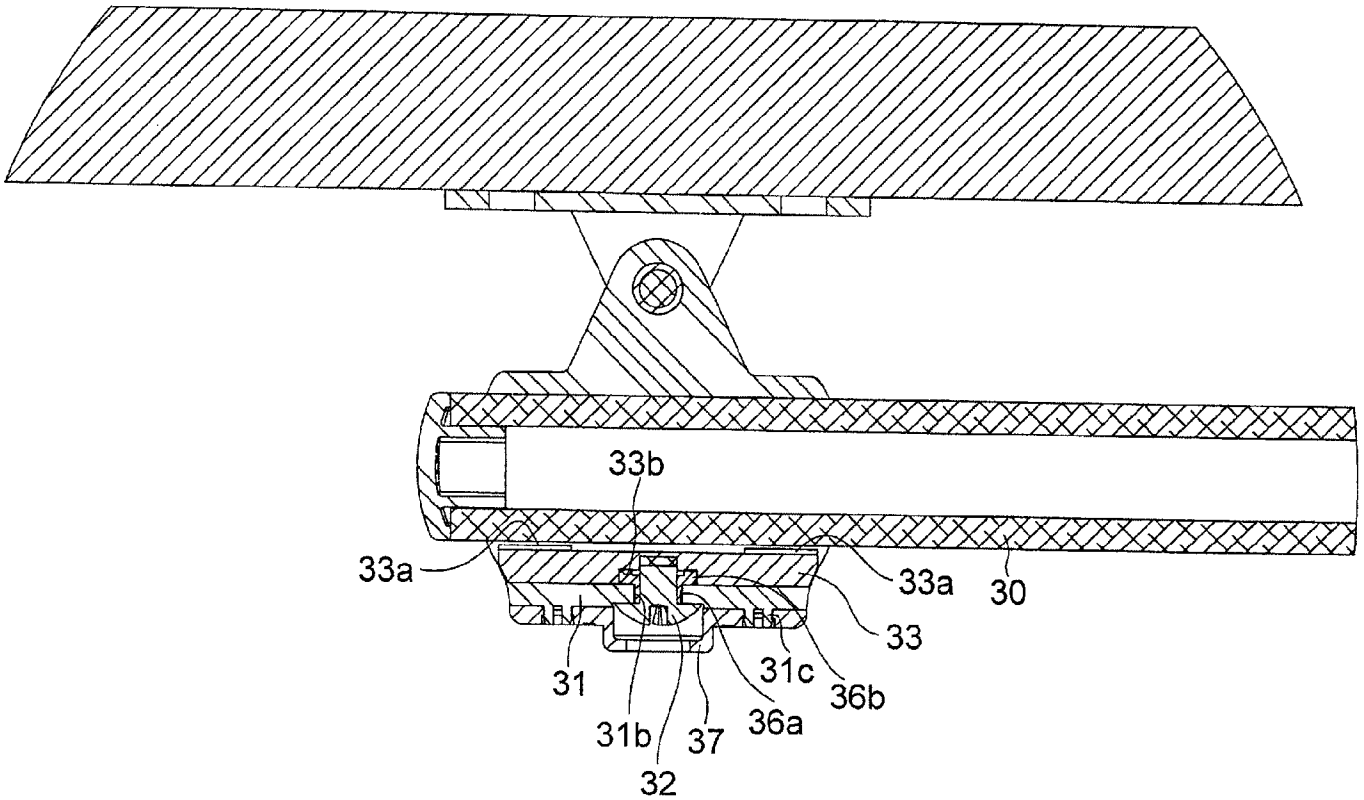
FIG. 6 is a cross sectional view of an arm and a slider.

At the bottom of the slider main body, a female screw part 36 is fit therein. The female screw part 36 has a cylindrical female screw main body 36*a* having an inner circumference on which a female screw is formed and a square-shaped flange 36*b* provided integrally at the upper end of the female screw main body 36*a*. As illustrated in FIG. 6, the female screw main body 36*a* of the female screw part 36 is fit in the hole 31*b* at the bottom of the slider main body 31. The flange 36*b* of the female screw part 36 is placed on the upper surface of the bottom of the slider main body 31. In the female screw part 36, a position adjusting screw 32 is turned from the outside. The position adjusting screw 32 is cove red with a decorated plate 37 for improving the appearance and preventing the position adjusting screw 32 from turning carelessly. The decorated plate 37 is pressed and fixed to a hook 31*c* of the slider main body 31.

The friction plate 33 is provided between the arm main body 30 and the slider main body 31. The friction plate 33 is made of springy synthetic resin. On a contact surface of the friction plate 33 with the arm main body 30, a one-step raised contact part 33*a* (see FIG. 5) is formed. On a back surface of the friction plate 33, a notch 33*b* is formed corresponding to the flange 36*b* of the female screw part 36. As the flange 36*b* of the female screw part 36 is fit in the notch 33*b* of the friction plate 33, the friction plate 33 is able to slide together with the slider main body 31.

Figure 7:
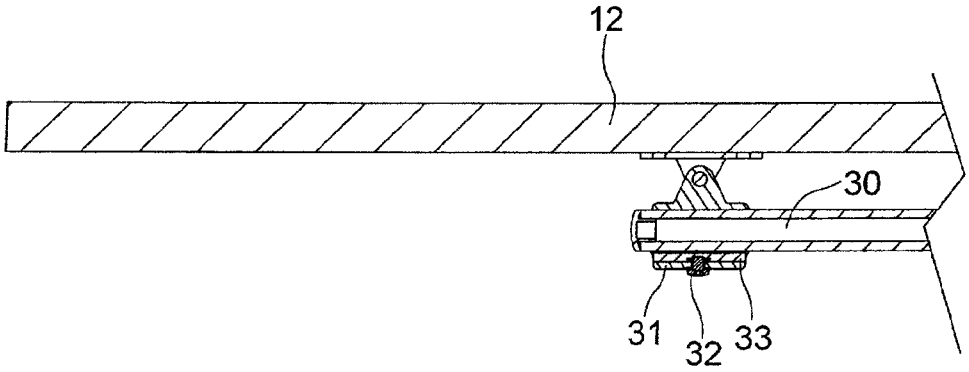
FIGS. 7(*a*) and 7(*b*) are cross sectional views of the arm installed on the door and the slider (FIG. 7(*a*) illustrates a space provided between an arm main body and a friction plate and FIG. 7(*b*) illustrates the arm main body and the frictional plate that are in close contact with each other)
Figure 7:
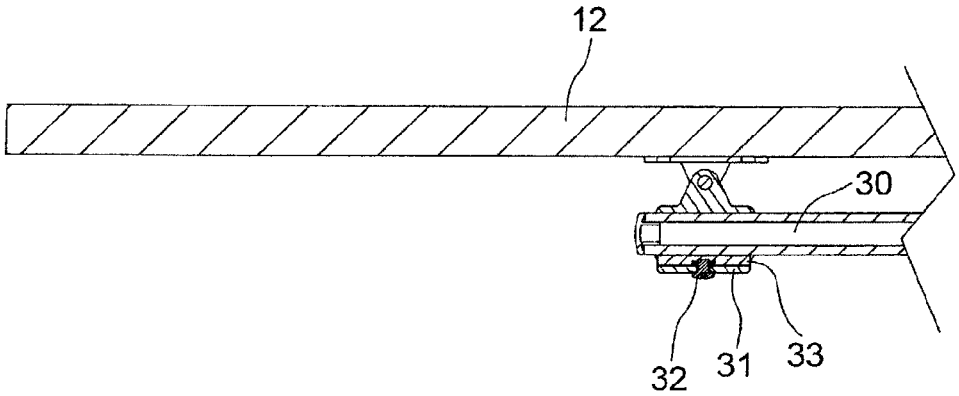

The friction plate 33 goes back and forth toward the arm main body 30 by the action of feed screw of the position adjusting screw 32. By adjusting a contact pressure of the friction plate 33 with the arm main body 30, the resistance when the slider main body 31 slides relative to the arm main body 30 is adjusted. As illustrated in FIG. 7(*a*), in order to facilitate opening of the door 12, a space is provided between the arm main body 30 and the friction plate 33. On the other hand, as illustrated in FIG. 7(*b*), in order to make it difficult to open the door 12, the space between the arm main body 30 and the friction plate 33 is removed so that the arm main body 30 is in close contact with the friction plate 33.

As illustrated in FIG. 4 again, a damper 41 for generating a damping force by viscosity resistance of a fluid is build in the main body 15. When the arm 14 rotates a predetermined angle or more, the arm 14 comes into contact with a movable part 42 of the damper 41 and the damper 41 is compressed. With compression of the damper 41, a force of damping rotation is given to the arm 14. As the damper 41 is provided, it is possible to reduce the impact of the door 12 when it gets closed and comes into collision with the housing 11.

Figure 8:
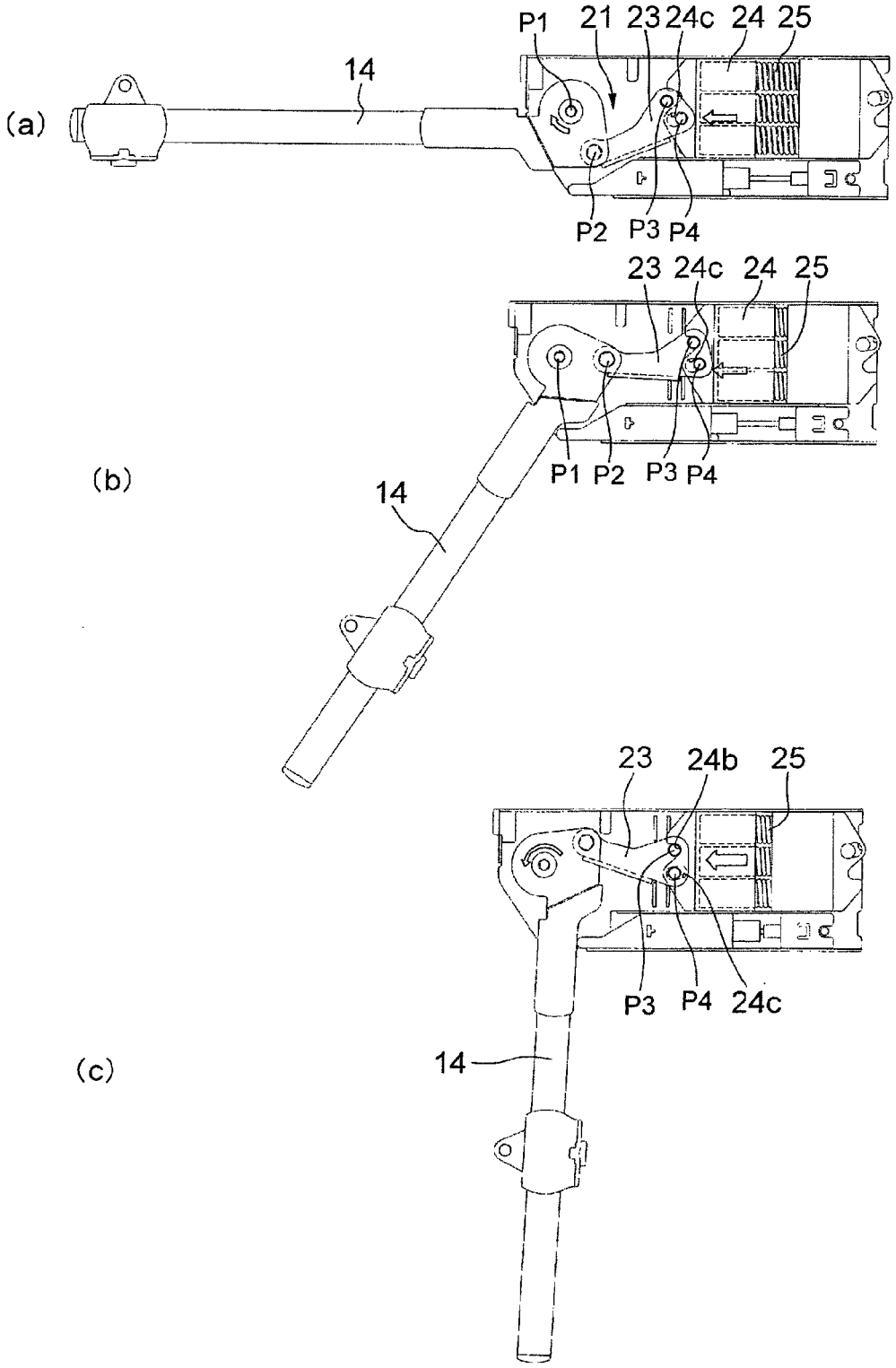
FIGS. 8(*a*) to 8(*c*) are operational views of a slider crank mechanism (FIG. 8(*a*) illustrates the door in the open state, FIG. 8(*b*) illustrates the slider crank mechanism that has reached a change point, and FIG. 8(*c*) illustrates the door in the closed state)

As illustrated in FIGS. 8(*a*) to 8(*c*), the arm 14, the link 23 and the main-body slider 24 of the stay form the slider crank mechanism 21. As illustrated in FIG. 8(*a*), when the door 12 is open, the pin P4 of the link 23 is fit at the right end of the long hole 24*c* of the main-body slider 24. In this state, the pivot of the link 23 relative to the main-body slider 24 is the pin P4. The biasing force of the coil springs 25 contained in the main body 15 is transmitted, as a torque, via the pin P4, the link 23 and the pin P2 to the arm 14 which is equivalent to a crank. When the door 12 is open, an additional torque in the opening direction of the door 12 acts on the arm 14.

As illustrated in FIG. 8(*b*), when the door 12 is rotated in the closing direction (the arm 14 is rotated in the counterclockwise direction relative to the main body 15), the slider crank mechanism 21 reaches the change point. In other words, the arm 14 can rotates both in the counterclockwise direction and in the clockwise direction, and the torque from the coil springs 25 is not transmitted to the arm 14.

As illustrated in FIG. 8(*c*), when the door 12 is further rotated in the closing direction (the arm 14 is further rotated in the counterclockwise direction relative to the main body 15), the slider crank mechanism goes beyond the change point and the torque in the closing direction of the door 12 acts on the arm 14 by the biasing force of the coil springs 25.

In the stay using the slider crank mechanism 21 like in the present embodiment, the weight of the door 12 is supported by the biasing force of the coil springs 25. Then, the biasing force of the coil springs 25 is also used in a catch force in the closing direction of the door 12 by using the change point of the slider crank mechanism 21. When the door 12 is heavy, it is necessary to support the door 12 by strengthening the biasing force of the coil springs 25. However, if the biasing force is strengthened, the catch force is strengthened thereby to increase the load of opening the door 12. In order to prevent this, in the present embodiment, as illustrated in FIGS. 8(*b*) and 8(*c*), the pivot of the link 23 relative to the main-body slider 24 is changed from the pin P4 to the pin P3. That is, as illustrated in FIG. 8(*c*), when the link 23 rotates, the pin P4 fit in the right end of the long hole 24*c* of the main-body slider 24 is lifted up and instead, the pin P3 is fit in the recess 24*b* of the main-body slider 24. Then, the pivot of the link 23 relative to the main-body slider 24 is changed from the pin P4 to the pin P3.

Figure 9:
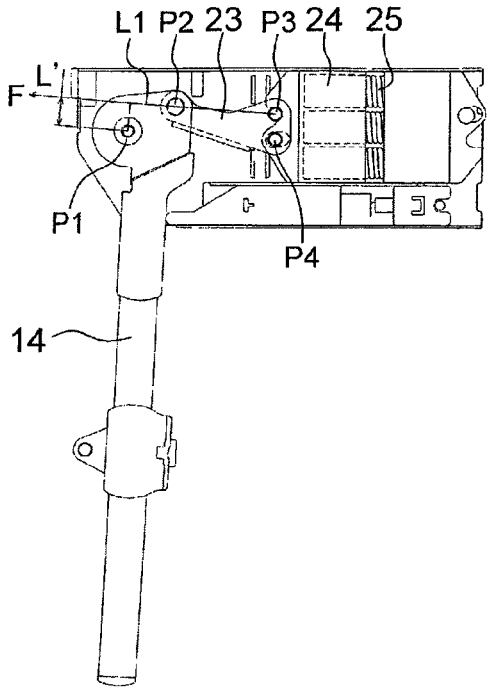
FIGS. 9(*a*) and 9(*b*) are views each illustrating a torque that acts on the arm by the slider crank mechanism in which the pins are changed (FIG. 9(*a*) illustrates an example of the present embodiment and FIG. 9(*b*) illustrates a comparative example)
Figure 9:
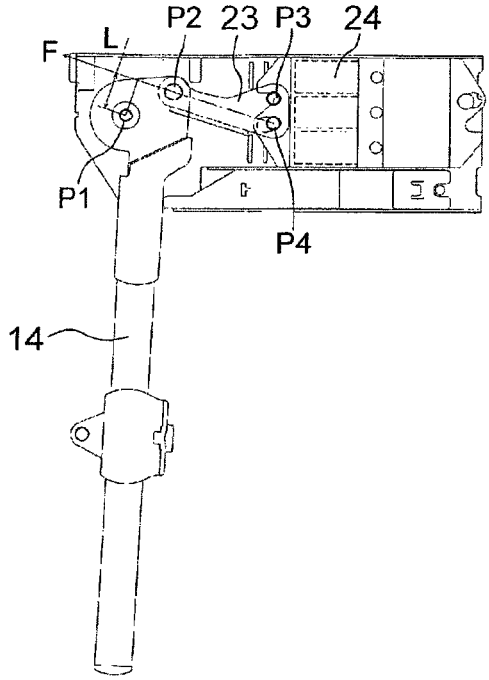

As illustrated in FIG. 9(*a*), a force F is transmitted from the link 23 to the arm 14 in a direction connecting the pin P3 of the link 23 to the pin P2. The torque transmitted to the arm 14 is expressed by the force F×the arm length L. The arm length L' is expressed by a distance from the pivot of the arm 14 (pin P1) to the line L1 connecting the pin P3 and the pin P2 of the link 23. As the pin as pivot of the link 23 relative to the main-body slider 24 is changed from P4 to P3, the arm length L' can be shortened. This makes it possible to reduce the torque on the arm 14 and to reduce the catch force of the door 12 in the closed state.

FIG. 9(*b*) illustrates a comparative example when the pin is not changed. If the pin is not changed, the arm length L gets longer. Therefore, F×L cannot be reduced and the torque that acts on the arm 14 also cannot be reduced.

Figure 10:
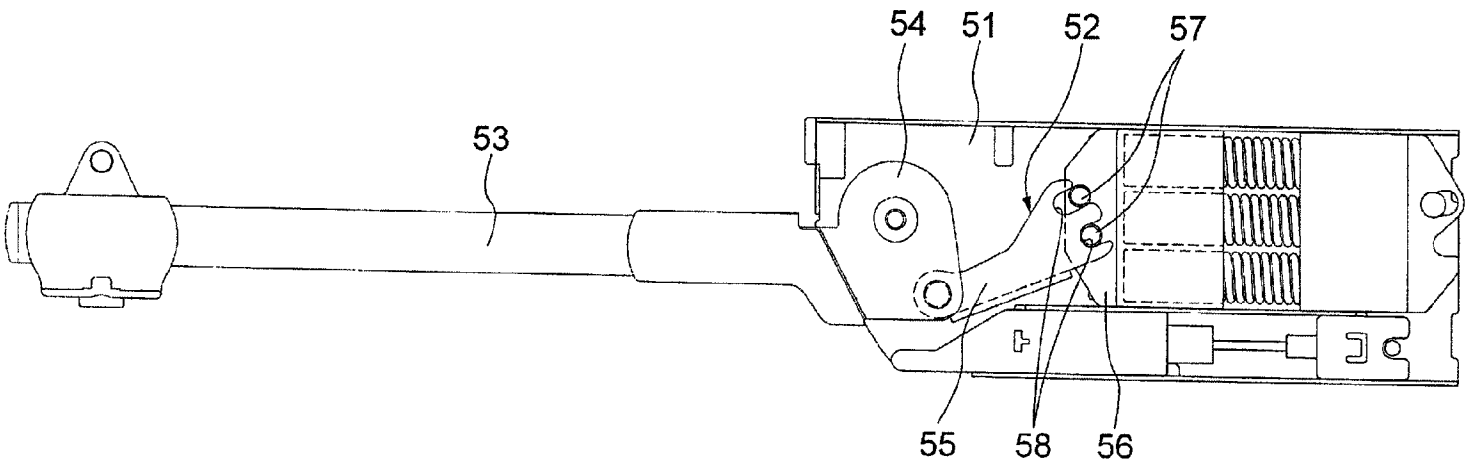
FIG. 10 is a substantial part cross sectional view of a stay for opening and closing of a door according to a second embodiment of the present invention.

FIG. 10 is a substantial part cross sectional view of a stay for opening and closing of a door according to a second embodiment of the present invention. In this embodiment, like the stay for opening and closing of a door according to the first embodiment described above, a slider crank mechanism 52 is built in a main body 51. The slider crank mechanism 52 has an arm 52, a link 55 connected to arm holding plates 54 of the arm 53 and a main-body slider 56 provided on the main body 51 to be slidable in one direction. However, in the stay according to the second embodiment, two pins 57 are provided on the main-body slider 56 and two pin receivers 58 are provided on the link 55 corresponding to the two pins 57, which is different from that in the stay according to the above-described first embodiment. The pivot of the link 55 is switched between the pins 57 by rotation of the link 55 relative to the main-body slider 56, like in the above-described first embodiment.

Figure 11:
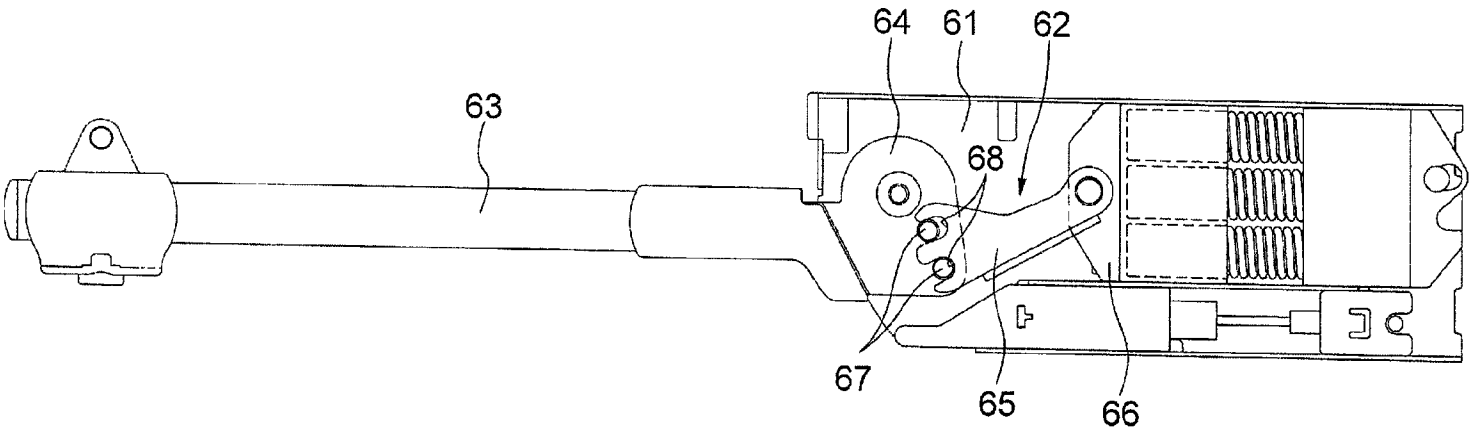
FIG. 11 is a substantial part cross sectional view of a stay for opening and closing of a door according to a third embodiment of the present invention.

FIG. 11 is a substantial part cross sectional view of a stay for opening and closing of a door according to a third embodiment of the present invention. In this embodiment, like the stay for opening and closing of a door according to the first embodiment described above, a slider crank mechanism 62 is built in a main body 61. The slider crank mechanism 62 has an arm 62, a link 65 connected to arm holding plates 64 of the arm 63 and a main-body slider 66 provided on the main body 61 to be slidable in one direction. However, in the stay according to the third embodiment, two pins 67 are provided on the arm holding plates 64 and two pin receivers 68 are provided on the link 65 corresponding to the two pins 67, which is different from those in the stays according to the above-described first and second embodiments. The pivot of the link 65 is switched between the pins 67 by rotation of the link 65 relative to the arm holding plates 64, like in the above-described first and second embodiments.

Here, the present invention is not limited to the above-described embodiments and may be embodied in various forms without departing from the scope of the present invention. For example, the direction of the torque that acts on the arm and the open and closed state of the door can be determined freely. Irrespective of the open and closed state of the door, the toque may always act in opening or closing direction. Besides, the torque in closing direction may act when the door is open, and the torque in opening direction may act when the door is closed.

Further, three or more pins may be provided as axes of rotation in the arm, link and main-body slider, or two pins may be provided in the arm and link or the link and main-body slider.

The present specification is based on Japanese Patent Applications No. 2009-045498 filed on Feb. 27, 2009, the entire contents of which are expressly incorporated by reference herein.

11 . . . housing
12 . . . door
14, 53, 63 . . . arm
15, 51, 61 . . . main body
16 . . . arm slider
17 . . . mounting seat
23, 55, 65 . . . link
24*b* . . . recess (pin receiver)
24*c* . . . long hole (pin receiver)
24, 56, 66 . . . main-body slider
31 . . . slider main body
32 . . . position adjusting screw
33 . . . friction plate
P1 to P5 . . . pin

The invention claimed is:

1. A stay for opening and closing an outward-opening door or an outward-opening cover configured to facilitate an opening and closing operation thereof installed on a housing via a hinge in an openable and closable manner, comprising:

a hinge mounted to a housing and a door or a cover;

a main body mounted to a side plate of the housing;

an arm having one end rotatably connected to the main body;

biasing means provided to the main body for biasing the arm so that the arm can rotate in at least one direction;

an arm slider mounted to the arm so as to be slidable in a longitudinal direction of the arm; and a mounting seat installed on an inner surface of the door or the cover and rotatably connected to the arm slider, wherein, when the door or the cover moves from a fully open position to a fully closed position, and when the door or the cover moves from the fully closed position to the fully open position, a length from the arm slider to a rotation center of the arm continuously changes, and wherein, when seen from a direction of the rotation center of the arm, a pin which is a rotation center of the mounting seat relative to the arm slider is located away from the arm between the door or the cover and the arm located inside the door or the cover, wherein the arm slider has a slider main body which takes a shape of a frame surrounding the arm, and a projection which is formed integrally with the slider main body and in which a hole for the pin to fit in is formed, wherein the mounting seat has a plate main body mounted to the door or the cover, and a projection plate which is formed integrally with the plate main body and in which a hole for the pin to fit in is formed, and wherein a screw is fit in the pin through the projection of the arm slider.

2. The stay of claim 1, further comprising:

resistance adjusting means for adjusting a resistance when the arm slider slides relative to the arm.

3. The stay of claim 2, wherein the biasing means has a main-body slider slidably provided on the main body and being biased in one direction by an elastic body; and a link rotatably and unslidably connected to the main-body slider and the arm, wherein there are at least two pivots of the link relative to the arm or the main-body slider, wherein the arm gives the door or the cover a force in an opening direction so as to keep the door or the cover stable in the fully open position, and the arm gives the door or the cover a force in a closing direction so as to keep the door or the cover stable in the fully closed position, and wherein, when the door or the cover moves from the fully open position to the fully closed position, the pivots of the link relative to the arm or the main-body slider are changed from one pin to an opposite pin so as to reduce the force in the closing direction given by the arm to the door or the cover in the fully closed position.

4. The stay of claim 2, wherein the resistance adjusting means has a slider main body which takes a shape of a frame surrounding the arm, a position adjusting screw which is fit in the slider main body, and a friction plate which is provided between the arm and the slider main body and moves back and forth toward the arm by turning the position adjusting screw, and wherein the resistance of the slider sliding relative to the arm is adjusted by moving the friction plate back and forth toward the arm.

5. The stay of claim 1, wherein the biasing means has a main-body slider, slidably provided on the main body and being biased in one direction by an elastic body, and a link rotatably and unslidably connected to the main-body slider and the arm, wherein there are at least two pivots of the link relative to the arm or the main-body slider, wherein the arm gives the door or the cover a force in an opening direction so as to keep the door or the cover stable in the fully open position, and the arm gives the door or the cover a force in a closing direction so as to keep the door or the cover stable in the fully closed position, and wherein, when the door or the cover moves from the fully open position to the fully closed position, the pivots of the link relative to the arm or the main-body slider are changed from one pin to an opposite pin so as to reduce the force in the closing direction given by the arm to the door or the cover in the fully closed position.

6. A stay for opening and closing an outward-opening door or an outward-opening cover configured to facilitate an opening and closing operation thereof installed on a housing via a hinge in an openable and closable manner, comprising:

a hinge mounted to a housing and a door or a cover;

a main body mounted to a side plate of the housing;

an arm having one end rotatably connected to the main body;

biasing means provided to the main body for biasing the arm so that the arm can rotate in at least one direction;

an arm slider mounted to the arm so as to be slidable in a longitudinal direction of the arm; and a mounting seat installed on an inner surface of the door or the cover and rotatably connected to the arm slider, wherein, when the door or the cover moves from a fully open position to a fully closed position, and when the door or the cover moves from the fully closed position to the fully open position, a length from the arm slider to a rotation center of the arm continuously changes, wherein, when seen from a direction of the rotation center of the arm, a rotation center of the mounting seat relative to the arm slider is located away from the arm between the door or the cover and the arm located inside the door or the cover, wherein the biasing means has a main-body slider slidably provided on the main body and being biased in one direction by an elastic body; and a link rotatably and unslidably connected to the main-body slider and the arm, wherein there are at least two pivots of the link relative to the arm or the main-body slider, wherein the arm gives the door or the cover a force in an opening direction so as to keep the door or the cover stable in the fully open position, and the arm gives the door or the cover a force in a closing direction so as to keep the door or the cover stable in the fully closed position, and wherein, when the door or the cover moves from the fully open position to the fully closed position, the pivots of the link relative to the arm or the main-body slider are changed from one pin to an opposite pin so as to reduce the force in the closing direction given by the arm to the door or the cover in the fully closed position.

7. The stay of claim 6, further comprising:

resistance adjusting means for adjusting a resistance when the arm slider slides relative to the arm.

8. The stay of claim 7, wherein the resistance adjusting means has a slider main body which takes a shape of a frame surrounding the arm, a position adjusting screw which is fit in the slider main body, and a friction plate which is provided between the arm and the slider main body and moves back and forth toward the arm by turning the position adjusting screw, and wherein the resistance of the slider sliding relative to the arm is adjusted by moving the friction plate back and forth toward the arm.

9. A stay for opening and closing of a door or a cover, comprising:

a main body mounted to a housing;

an arm having one end rotatably connected to the main body and being connected to the door or the cover;

a main-body slider slidably provided on the main body and being biased in one direction by an elastic body; and a link rotatably and unslidably connected to the main-body slider and the arm, wherein there are at least two pivots of the link relative to the arm or the main-body slider, wherein the arm gives the door or the cover a force in an opening direction so as to keep the door or the cover stable in a fully open position, and the arm gives the door or the cover a force in a closing direction so as to keep the door or the cover stable in a fully closed position, and wherein, when the door or the cover moves from the fully open position to the fully closed position, the pivots of the link relative to the arm or the main-body slider are changed from one pin to an opposite pin so as to reduce the force in the closing direction given by the arm to the door or the cover in the fully closed position.

10. The stay of claim 9, further comprising:

resistance adjusting means for adjusting a resistance when the arm slider slides relative to the arm.

11. The stay of claim 10, wherein the resistance adjusting means has a slider main body which takes a shape of a frame surrounding the arm, a position adjusting screw which is fit in the slider main body, and a friction plate which is provided between the arm and the slider main body and moves back and forth toward the arm by turning the position adjusting screw, and wherein the resistance of the slider sliding relative to the arm is adjusted by moving the friction plate back and forth toward the arm.

* * * * *